United States Patent [19]

Johnson, Jr.

[11] 4,324,083

[45] Apr. 13, 1982

[54] SPACE FRAME

[75] Inventor: Alfred L. Johnson, Jr., Manhattan Beach, Calif.

[73] Assignee: LaJet Energy Company, Abilene, Tex.

[21] Appl. No.: 154,141

[22] Filed: May 29, 1980

[51] Int. Cl.[3] ..... E04H 12/00; E04B 5/14

[52] U.S. Cl. ..... 52/650; 52/648; 403/172; 403/217; 403/219

[58] Field of Search ..... 52/650, 648; 403/171, 403/172, 217, 219

[56] References Cited

U.S. PATENT DOCUMENTS

| | | | |
|---|---|---|---|
| 2,658,776 | 11/1953 | Wilcox | 287/54 |
| 2,964,147 | 12/1960 | Fentiman | 189/34 |
| 2,976,968 | 3/1961 | Fentiman | 189/34 |
| 3,270,478 | 9/1966 | Attwood | 52/648 |
| 3,309,121 | 3/1967 | Fentiman | 287/189.36 |
| 3,323,820 | 6/1967 | Braccini | 287/189.36 |
| 3,443,348 | 5/1969 | Papayoti | 52/299 |
| 3,485,005 | 12/1969 | Kutchai | 52/643 |
| 3,914,063 | 5/1973 | Papayoti | 403/406 |
| 3,918,233 | 2/1974 | Simpson | 52/747 |
| 4,183,190 | 1/1980 | Bance | 52/648 |
| 4,211,044 | 7/1980 | Gugliotta et al. | 52/200 |

FOREIGN PATENT DOCUMENTS

| | | |
|---|---|---|
| 2444612 | 4/1976 | Fed. Rep. of Germany . |
| 682854 | 6/1930 | France . |
| 581277 | 8/1958 | Italy . |

*Primary Examiner*—Alfred C. Perham

*Attorney, Agent, or Firm*—Roylance, Abrams, Berdo & Farley

[57] ABSTRACT

A space frame formed from a first set of beams and joints in a first plane and a second set of beams and joints in a second plane, the joints in the two planes being interconnected by diagonal tubular struts. Each strut has two shafts at opposite ends which are received, respectively, in apertures in a joint in the first plane and a joint in the second plane. Each shaft has a fastening member coupled thereto for maintaining the shaft in the aperture. Each shaft extends along the longitudinal axis of the associated tubular strut.

13 Claims, 18 Drawing Figures

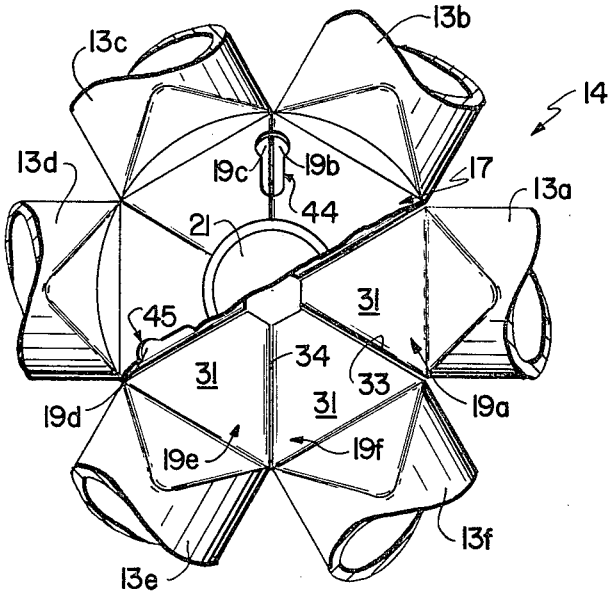
FIG. 5
FIG. 10
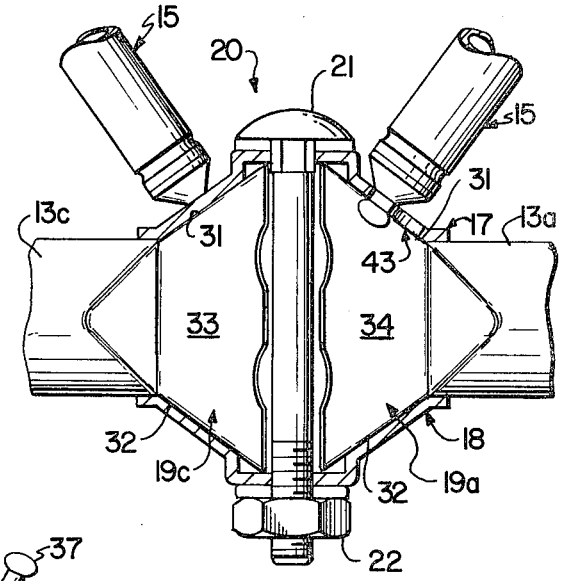
FIG. 6
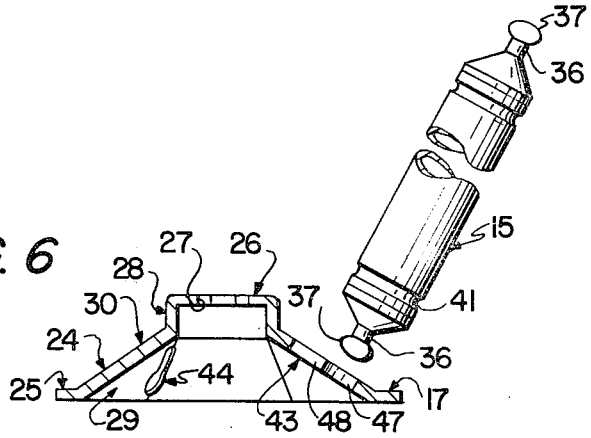
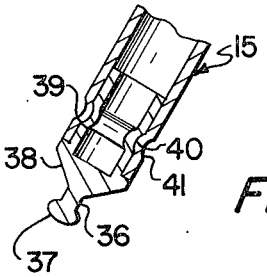
FIG. 7
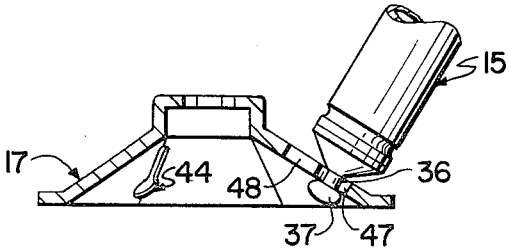
FIG. 8
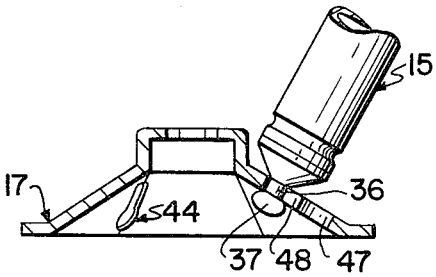
FIG. 9

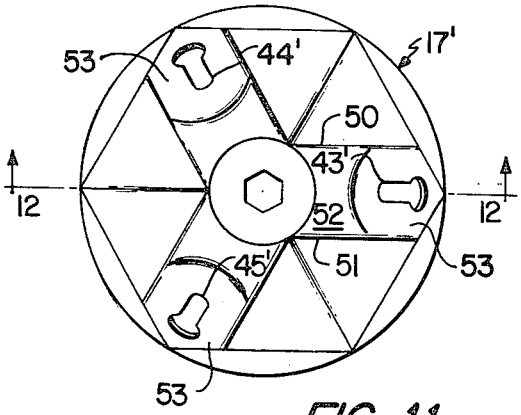
FIG. 11
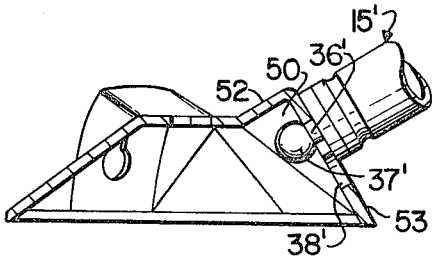
FIG. 12
FIG. 14
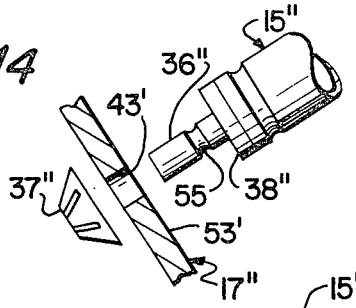
FIG. 15
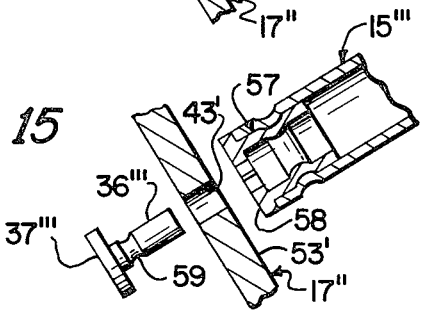
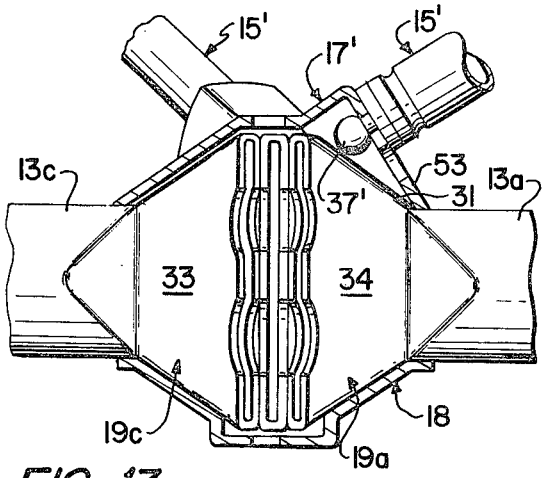
FIG. 13
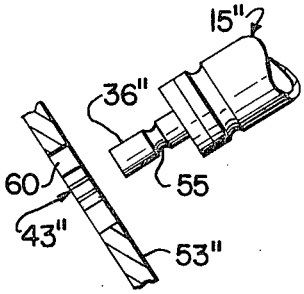
FIG. 16
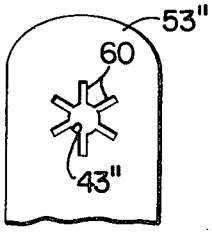
FIG. 17
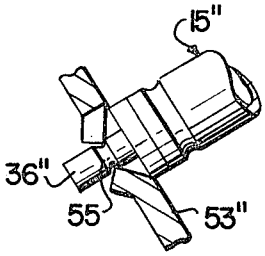
FIG. 18

SPACE FRAME

FIELD OF THE INVENTION

The present invention relates to a space frame formed of a plurality of beams interconnected by a plurality of joints. The frame has a first set of beams and joints in a first plane and a second set of beams and joints in a second plane, the joints in the two planes being interconnected by diagonal tubular struts.

BACKGROUND OF THE INVENTION

Skeleton frameworks in the form of trusses, space frames and lattice-works are well known in the art for supporting various objects or for forming load bearing walls for building structures. Unfortunately, many of these prior art structures are very expensive to mass produce since the joints coupling the elongated beams or struts forming the structure have traditionally been very complicated, require extensive machining and require numerous fasteners such as nuts and bolts. In addition, many of these prior art structures are very difficult to assemble and are heavy.

Moreover, many of the prior art structures utilize joints which do not adequately rigidly couple the elongated members forming the structure, which can result in failure after initial erection. Many of these prior art structures also do not utilize tubular beams, but instead utilize solid rods which are very expensive to make, are very heavy and do not have great resistance to bending.

In those cases where tubular beams are used, for example, as diagonal members interconnecting two planar arrays of beams and joints, the beams traditionally require large outer diameters to withstand the bending moments to which they are subjected. This adds expense and weight to the entire structure.

Such prior art structures are disclosed in the following U.S. Pat. Nos. 2,964,147, issued to Fentiman on Dec. 13, 1960; 2,976,968, issued to Fentiman on Mar. 28, 1961; 3,270,478 issued to Attwood on Sept. 6, 1966; 3,309,121, issued to Fentiman on Mar. 14, 1967; 3,323,820, issued to Braccini on June 6, 1967; 3,443,348, issued to Papayoti on May 13, 1969; 3,485,005, issued to Kutchai on Dec. 23, 1969; 3,914,063, issued to Papayoti on Oct. 21, 1975; and 3,918,233, issued to Simpson on Nov. 11, 1975. In addition, such prior art structures are disclosed in French Pat. No. 682,854, issued to Doornbos et al. on June 3, 1930; Italian Pat. No. 581,277, issued to Industria Officine Magliana on Aug. 25, 1958; and German Offenlegungsschrift No. 2,444,612, issued to Arab on Apr. 1, 1976.

SUMMARY OF THE INVENTION

Accordingly, it is a primary object of the present invention to provide a space frame which is inexpensive to manufacture, easy to assemble, light and sufficiently rigid to withstand extensive bending moments.

Another object of the present invention is to provide such a frame which utilizes tubular beams as diagonal struts but minimizes their outside diameter, and therefore their weight and expense.

Another object of the present invention is to provide a space frame which can be manufactured with little machining of parts.

Another object of the present invention is to provide such a frame which can be assembled quickly by unskilled personnel.

The foregoing objects are basically attained by providing a space frame comprising a first set of beams; a first set of joints interconnecting said first set of beams in a rigid lattice in a first plane; a second set of beams; a second set of joints interconnecting said second set of beams in a rigid lattice in a second plane; and a plurality of tubular struts interconnecting the first and second sets of joints to form a rigid structure, each of the joints comprising a member having a plurality of apertures therein, each of the tubular struts having first and second shafts coupled at opposite ends and extending along the longitudinal axis of each of the tubular struts, the first shaft coupled to each strut being received in an aperture in a member in said first set of joints, the second shaft coupled to each strut being received in an aperture in a member in the second set of joints, each of the shafts having fastening means, coupled thereto, for maintaining the shaft in the associated aperture.

Advantageously, each joint is formed from a first and second cap receiving the ends of the beams therebetween and the apertures receiving the shafts on the tubular struts are located in the caps. Advantageously, the longitudinal axes of the diagonal struts and the shafts intersect substantially at the centroid of each joint, thereby reducing potential bending moments.

In the embodiment of FIGS. 1–10, each cap has a frustoconical portion having the apertures therein and each strut has a plug attached at the ends with a frustoconical portion leading to a cylindrical shaft having an enlarged end thereon. The apertures in the caps each comprises an enlarged portion and an elongated portion, the enlarged end of the shaft fitting into the enlarged portion, the shaft then being moved transversely into the elongated portion with the enlarged end maintaining the strut in the aperture.

In the embodiment of FIGS. 11–13, the cap having the apertures therein has three raised walls to receive a flat end of the strut.

In the embodiment of FIG. 14, a split locking washer is used in fasten the shaft in the aperture of the cap shown in FIG. 11.

In the embodiment of FIG. 15, a split locking washer is defined in the end of the strut and receives a shaft therein which has an enlarged head for maintaining the shaft in the aperture, the cap being the same as that shown in FIG. 11.

In the embodiment of FIGS. 16–18, an aperture to receive the shaft has a plurality of slots about the periphery, the portions of the periphery between the slots fastening the shaft to the cap.

Other objects, advantages and salient features of the present invention will become apparent from the following detailed description which, taken in conjunction with the annexed drawings, disclosures preferred embodiments of the present invention.

DRAWINGS

Referring not to the drawings which form a part of this original disclosure:

FIG. 5 is a view similar to that shown in FIG. 4 except that part of the cap is broken away to show the end portions of the interconnected tubular beams;

FIG. 6 is a vertical sectional view taken along lines 6—6 in FIG. 4 showing a cap about to receive a diagonal strut in the aperture therein;

FIG. 7 is a vertical longitudinal sectional view of the diagonal strut shown in FIG. 6;

FIG. 8 is a view similar to that shown in FIG. 6 except that the enlarged end on the shaft extending from the diagonal strut has passed through the enlarged portion of the aperture in the cap;

FIG. 9 is a view similar to that shown in FIG. 8 except that the diagonal strut has been moved so that the shaft thereon is received in the elongated portion of the aperture in the cap and the enlarged end maintains the shaft in the aperture;

FIG. 10 is a vertical sectional view taken along lines 6—6 is FIG. 4 but also having two diagonal struts received in the apertures therein;

FIG. 11 is a top plan view of a modified cap in accordance with the present invention;

FIG. 12 is a vertical sectional view of the cap taken along lines 12—12 in FIG. 11 with a modified diagonal strut received therein;

FIG. 13 is a vertical sectional view similar to that shown in FIG. 10 except that the modified cap of FIG. 11 is utilized and the central nut and bolt have been removed for clarity;

FIG. 14 is a fragmentary side view of a modified diagonal strut and fastening member therefor;

FIG. 15 is a fragmentary longitudinal section of a further modified diagonal strut and fastening member therefor;

FIG. 16 is a fragmentary side view of another modified fastening member;

FIG. 17 is an elevational view of the fastening member of FIG. 16; and

FIG. 18 is a fragmentary side view of a shaft received in the fastening member of FIGS. 16 and 17.

DETAILED DESCRIPTION OF THE INVENTION

Figure 1:
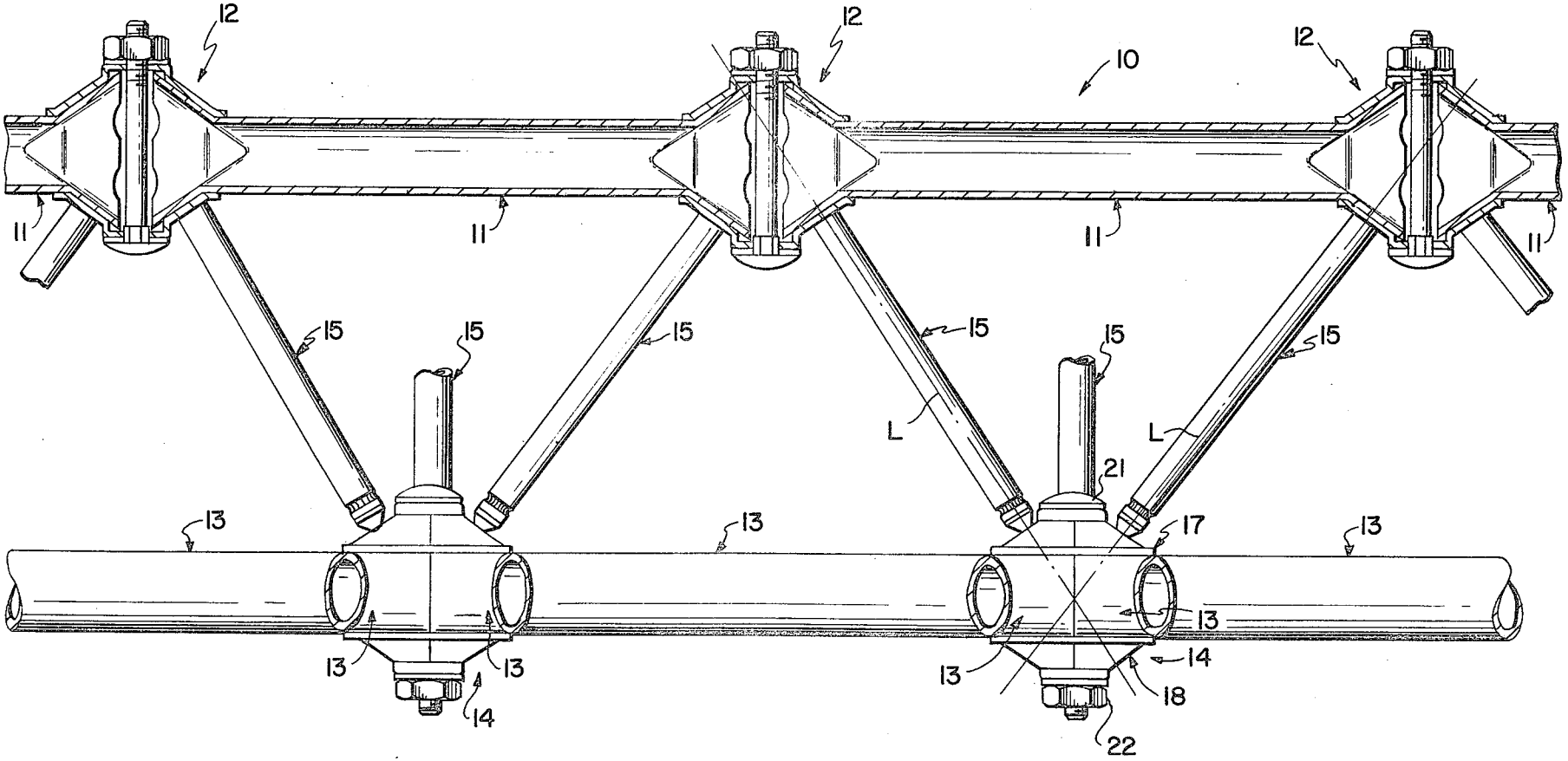
FIG. 1 is a sectional view of a space frame in accordance with the present invention taken along lines 1—1 in FIG. 2.
Figure 2:
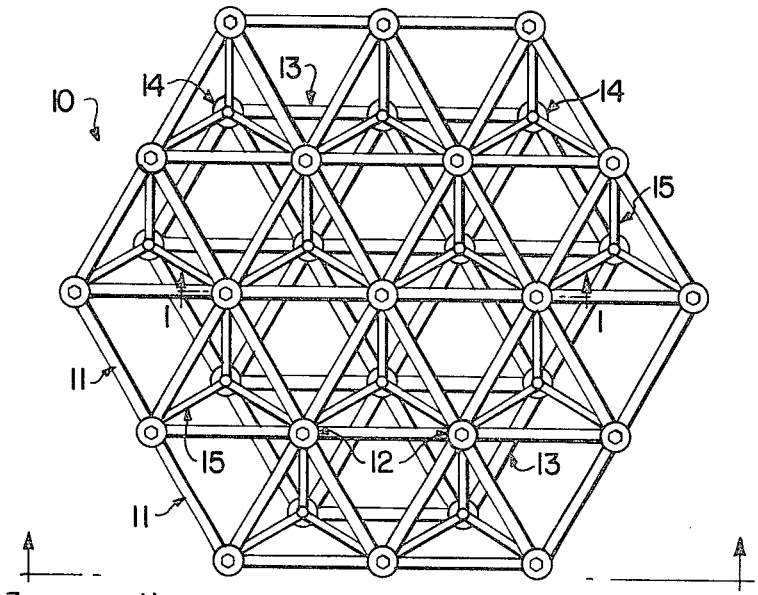
FIG. 2 is a top plan view of a space frame in accordance with the present invention.
Figure 3:
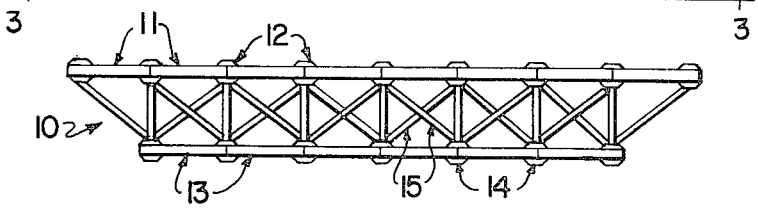
FIG. 3 is a side elevational view of the space frame shown in FIG. 2.

Referring now to FIGS. 1-3, the space frame 10 in accordance with the present invention is shown to comprise a first set of beams 11, a first set of joints 12 interconnecting the first set of beams in a rigid lattice in a first plane, a second set of beams 13, a second set of joints 14 interconnecting the second set of beams in a second rigid lattice in a second plane, and a plurality of diagonal tubular struts 15 interconnecting the first and second sets of joints to form a rigid structure. Advantageously, as seen in FIG. 1, the longitudinal axes L of the diagonal struts intersect substantially at the centroid of each joint.

Preferably, the beams 11 and 13 are tubular and the struts 15 are also tubular.

The joints in the first and second set are formed in the same manner and are merely inverted versions of each other, as seen in FIG. 1. Except for the joints on the outer peripheries of the first and second sets of beams and joint, each joint 12 and 14 receives six beams and interconnects them in an array defining equilateral triangles. Each of the joints in the second set receives three diagonal tubular struts 15, as seen in FIGS. 1-3, while only the interior joints in the first set receive three struts. The exterior joints receive either one or two struts.

As seen in FIGS. 1, 4, 5, 6 and 10, each joint 14 comprises a first cap 17, a second cap 18, six end portions 19*a–f* of six tubular beams 13*a–f* received between the caps, and a fastener 20 formed from a bolt 21 and a nut 22. The end portions of each tubular beam are rigidly received between the inner surfaces of the opposed first and second caps, which are secured together by means of fastener 21.

As seen in FIGS. 1 and 10, the first and second caps 17 and 18 are mirror images, except that the first cap 17 has apertures therein for the diagonal struts while the second cap 18 does not, each comprising a tapering tubular portion 24, an annular flange 25 at the larger diameter of the tubular portion, and a closed end 26 near the smaller end of the tubular portion. The closed end is in the shape of a disc and has a central bore 27 therein. As seen in FIGS. 6 and 10, a short cylindrical portion 28 is located above the tapering tubular portion 24 just below the closed end 26. The tapering tubular portion 24 has an internal surface 29 and an external surface 30, both of which are in the form of a six-sided frustum comprised of six planar, trapezoidal sections extending from the annular flange 25 up to the cylindrical portion 28.

Each tubular beam is completely hollow throughout its length including the end portion. Preferably, the main portion of each beam is cylindrical, with a cylindrical inner surface and a cylindrical outer surface.

Figure 4:
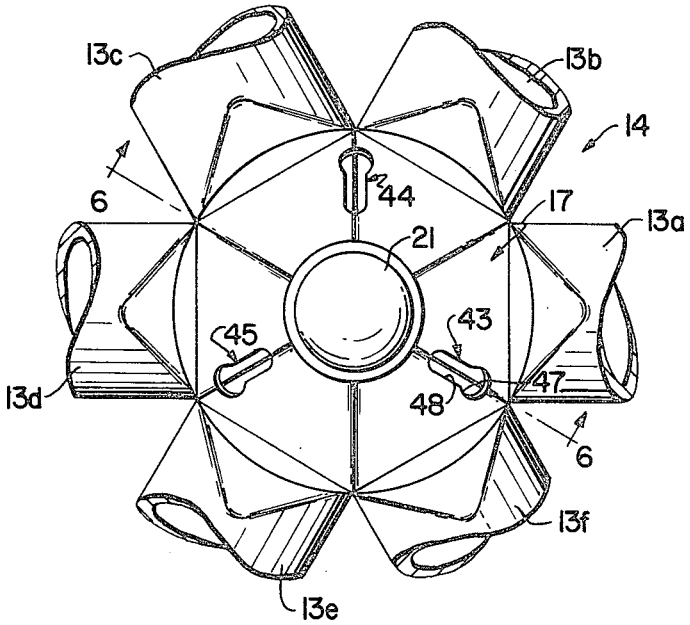
FIG. 4 is a top plan fragmentary view of a joint for interconnecting a plurality of beams forming the space frame without the diagonal tubular struts being shown.

Each end portion 19*a–f* of beams 13*a–f* shown in FIGS. 4, 5 and 10 is integrally formed with the main portion on each beam and is deformed into the configuration shown in FIGS. 1, 5 and 10. Each end portion comprises a first face 31, a second face 32, a third face 33 and a fourth face 34.

The first and second faces 31 and 32 are outwardly diverging and opposed from each other and are each substantially planar and trapezoidal. The larger base of each trapezoidal face is adjacent the connection of the end portion with the main portion of the beam.

The third and fourth faces 33 and 34 are inwardly converging and opposed and are each planar and trapezoidal, the larger base of the trapezoidal face being located at the distal end of the end portion.

As seen in FIG. 5, the third and fourth faces for each end portion of each beam converge at an angle of about 60° so that all six of the tubular beams are in a circular contacting array fully including 360°.

As seen in FIGS. 1 and 10, the angle of the taper of tubular portion 24 substantially coincides with the outwardly diverging angle of the first and second opposed faces 31 and 32 on each end portion so that the end portions are in contact with the interior surface 29 of the caps 17 and 18.

The outer perimeter of the end portion on each tubular beam is greater than the outer perimeter of the remaining part of each tubular beam, which is accomplished by stretching the end portion during its formation. This greatly reduces the chance that a tubular beam will be pulled out from the joint described herein. This concept is disclosed in prior filed, copending application of a common assignee, entitled TUBULAR BEAM JOINT, bearing Ser. No. 149,756 and having been filed on May 14, 1980 in the name of the inventor herein, the application hereby being incorporated by reference.

As seen in FIGS. 1 and 10, the fastener 20 formed by the bolt 21 and nut 22 rigidly couples the caps 17 and 18 together with the end portions of the tubular beams therebetween. The bolt 21 is received in central bores 27 in the first and second caps 17 and 18.

Referring now to FIGS. 1 and 6–10, three diagonal tubular struts 15 are seen rigidly fastened to all of the joints in the second set and the interior joints in the first set. Thus, each individual diagonal tubular strut 15 interconnects a joint in the first set and a joint in the second set. In particular, each diagonal tubular strut 15 is rigidly fastened to a cap in the first set of joints and a cap in the second set of joints.

As seen in FIG. 6, each diagonal strut 15 has a shaft 36 coupled at opposite ends and extending along the longitudinal axis thereof with a fastening member 37 at the end of the shaft 36. As seen in FIGS. 6 and 7, the shaft 36 is cylindrical and the fastening member 37 is in the form of an enlarged substantially spherical end of the shaft with an outer diameter greater than the diameter of the cylindrical shaft 36. As seen in FIG. 7, shaft 36 and fastening member 37 are integrally formed with a tapering portion 38 in frustoconical form which has a tubular portion 39 extending therefrom and having a slightly smaller diameter than the outer diameter of the larger base of the tapering portion 38. This tubular portion 39 has a peripheral groove 40 formed therein and is interposed inside the hollow tubular strut 15. A corresponding peripheral groove 41 is formed in the strut 15 by deforming it so as to capture the peripheral groove 40 therein to secure the tubular portion to the strut. Thus, a plug is formed by the integral formation of the shaft 36, fastening member 37, tapering portion 38, and the tubular portion 39.

As seen in FIGS. 4, 5, 6 and 10, the first cap 17 has three apertures 43, 44 and 45 formed in the tapering tubular portion 24 and spaced 120°. Each aperture has an enlarged circular portion 47 and an elongated portion 48, as seen in FIGS. 4 and 6. The inner diameter of the circular portion 47 is greater than the outer diameter of fastening member 37 so that the fastening member 37 can pass through the enlarged circular portion as seen in FIG. 8. The width of the elongated slot-like portion 48 is less than the diameter of the cylindrical shaft 36 so that the shaft 36 can slide therein, as seen in FIG. 9, once the fastening member 37 has passed through the enlarged portion 47. However, the fastening member 37 has an outer diameter which is greater than the width of the elongated portion 48 so it cannot pass through that portion. Preferably, the length of the shaft is equal to the width of the cap.

Thus, once the shaft 36 is received in the elongated portion 48, as seen in FIG. 9, the fastening member 37 maintains the shaft in the associated aperture, thereby interconnecting the strut 15 with the cap 17.

Thus, each of the tubular struts 15 has a first and a second shaft coupled at opposite ends, the first shaft being received in an aperture in a cap in the first set of joints and the second shaft being received in an aperture in a cap in the second set of joints, as seen in FIG. 1.

This provides rigidity between the first and second sets of beams and joints in the first and second planes; however, because of the connection of the struts to the caps a small diameter strut can be utilized, thereby reducing weight and expense while maintaining resistance to bending.

As seen in FIG. 10, after the diagonal strut 15 is connected to a cap 17 and the shaft received in the elongated portion 48 of each aperture, the end portions of the beams are placed with faces 31 adjacent and contacting cap 17 and into an abutting relationship with each of the fastening members 37 on each strut. This contact inwardly deforms the end portions slightly. This also forces the fastening member 37 into a tight abutting relationship with the inner surface 29 of the first cap 17. To finally assemble each joint, the second cap 18 is placed against faces 32 of each end portion and the bolt 21 and nut 22 are connected to rigidly clamp the end portions between the caps.

As seen in FIGS. 4, 5 and 10, each fastening member 37 abuts two adjacent end portions substantially at their contact line between faces 33 and 34 thereof.

Advantageously, in the connected configuration, the longitudinal axis of each shaft substantially intersects the centroid of each joint, as seen in FIGS. 1 and 10, to reduce potential bending moments.

Embodiment of FIGS. 11–13

As seen in FIGS. 11–13, a modified cap 17' is provided which is connectible to a modified diagonal strut 15'.

Basically, the cap is the same as that described above regarding FIGS. 1–10; however, three cavities are punched into the cap 17', each defined on its sides by planar, triangular walls 50 and 51 and on its top by a curvilinear wall 52 and a planar outer wall 53. As seen in FIG. 11, the cap has three 120° spaced apertures 43', 44' and 45' similar to the apertures described above regarding FIGS. 1–10 except that these apertures are formed in the three planar walls 53 on cap 17'.

As seen in FIG. 12, the modified diagonal strut 15' is the same as that described above regarding strut 15 except that the end face 38' of the strut 15' is planar and annular, rather than frustoconical as seen in FIG. 10 regarding strut 15. The shaft 36' as seen in FIG. 12 extends from the center of the end face 38' and has a substantially spherical fastening member 37' at the end thereof.

This combination of shaft 36' and fastening member 37' are received and coupled to the cap 17' in a manner similar to that described above, except that the planar end face 38' lies in abutting contact with the planar wall 53 on the cap 17'. Preferably, the length of shaft 36' is equal to the thickness of the cap 17' so there is a tight fit, as seen in FIGS. 12 and 13, between the cap and strut with the fastening member 37' being in engagement with the inner surface of the cap 17'.

As seen in FIG. 13, the fastening member 37' is also in an abutting relationship with face 31 of the end portion of the tubular beam 13*a*.

Embodiment of FIG. 14

A different mechanism for coupling the diagonal strut to the cap is shown in FIG. 14 in which the diagonal strut 15'' has a flat planar end face 38'' with a cylindrical shaft 36'' extending therefrom, which shaft is received in a circular aperture 43' in a planar wall 53' similar to that discussed above regarding cap 17', the cap being labeled 17'' in FIG. 14 because the apertures are different.

A split locking washer 37'' which is frustoconical on the inside and outside receives the shaft 36'' after it is received in aperture 43' and locks the shaft 36 to the cap 17''. A peripheral groove 55 can be provided in shaft 36'' to aid in the coupling of the washer 37'' with the shaft 36″ by having the smaller rim of the washer being received in the groove 55.

Embodiment of FIG. 15

In FIG. 15, a further modified diagonal strut 15‴ includes a plug 57 received in the end thereof having a split locking washer 58 formed as the end of the plug. A fastening member 37‴ in the form of a disc is rigidly coupled to a shaft 36‴ which passes through aperture 43′ and into a locking relationship with the split locking washer 58 on the end of strut 15‴. This washer has an interior diameter smaller than the outer diameter of the shaft, and the shaft, when it is pushed into the washer, extends the portions thereof between the slots formed in the washer outwardly of the plane of the washer. These portions then dig into the shaft, preventing its release. A peripheral groove 59 can be provided in shaft 36″ for the reception of the split locking washer interior peripheral rim.

Embodiment of FIGS. 16–18

In the embodiment of FIGS. 16–18, the diagonal strut is the same as that shown in FIG. 14. However, the fastening member is built into the cap. Thus, wall 53″ of a cap formed like cap 17″ has a circular aperture 43″ which has a plurality of slots 60 radiating outwardly therefrom as seen in FIGS. 16 and 17. The diameter of the aperture 43″ is smaller than the outer diameter of shaft 36″. When the shaft is pushed into the aperture, the portions of the wall 53″ between the slots 60 extend out of the plane of the wall into a substantially frustoconical shape, as seen in FIG. 18. The edges of these portions then dig into the shaft, preventing its release and forming the fastening member. As seen in FIG. 18, the edges are received in groove 55. This groove can be eliminated if desired.

While various advantageous embodiments have been chosen to illustrate the invention, it will be understood by those skilled in the art that various changes and modifications can be made therein without departing from the scope of the invention as defined in the appended claims.

What is claimed is:

1. A space frame comprising:
a first set of beams;
a first set of joints interconnecting said first set of beams in a rigid lattice;
a second set of beams;
a second set of joints interconnecting said second set of beams in a rigid lattice; and
a plurality of tubular struts interconnecting said first and second sets of joints to form a two layered rigid structure;
each of said joints comprising first and second caps receiving a plurality of beams therebetween, one of said caps having a plurality of apertures therein,
each of said tubular struts having first and second substantially cylindrical, non-threaded shafts coupled at opposite ends and extending along the longitudinal axis of each of said tubular struts,
the first shaft coupled to each strut being received in an aperture in a cap in said first set of joints,
the second shaft coupled to each strut being received in an aperture in a cap in said second set of joints,
each of said shafts having fastening means, coupled thereto and engaging a beam for maintaining the shaft in the associated aperture,
each of said caps having a tapering, annular wall, the inner surface of which engages the ends of the beams received therebetween,
each of said apertures for receiving said shafts being located in said tapering, annular wall.

2. A space frame comprising:
a first set of beams;
a first set of joints interconnecting said first set of beams in a rigid lattice in a first plane;
a second set of beams;
a second set of joints interconnecting said second set of beams in a rigid lattice in a second plane; and
a plurality of tubular struts interconnecting said first and second sets of joints to form a rigid structure,
each of said joints comprising first and second caps receiving a plurality of beams therebetween, one of said caps having a plurality of apertures therein,
each of said tubular struts having first and second substantially cylindrical, non-threaded shafts coupled at opposite ends and extending along the longitudinal axis of each of said tubular struts,
the first shaft coupled to each strut being received in an aperture in a cap in said first set of joints,
the second shaft coupled to each strut being received in an aperture in a cap in said second set of joints,
each of said shafts having fastening means, coupled thereto and engaging a beam, for maintaining the shaft in the associated aperture,
each of said caps having a tapering, annular wall, the inner surface of which engages the ends of the beams received therebetween,
each of said apertures for receiving said shafts being located in said tapering, annular wall.

3. A space frame according to claim 2, wherein
each of said apertures comprises an enlarged portion and an elongated portion, and
said fastening means comprises an enlarged end on each shaft which is smaller than said enlarged portion and can pass therethrough but is larger than said elongated portion and cannot pass therethrough.

4. A space frame according to claim 3, wherein
said enlarged portion is substantially circular, and
said enlarged end is substantially spherical.

5. A space frame according to claim 2, wherein
the end of each strut is substantially frustoconical, with each shaft extending from the smaller base thereof.

6. A space frame according to claim 2, wherein
the end of said strut is substantially planar, with each shaft extending from the center thereof.

7. A space frame according to claim 2, wherein
said fastening means comprises a split locking washer.

8. A space frame according to claim 2, wherein
each of said struts has a split locking washer at the ends receiving the shafts therein.

9. A space frame according to claim 2, wherein
each of said struts has a plug rigidly coupled to the ends, each plug carrying a shaft thereon.

10. A space frame according to claim 2, wherein
each of said caps having apertures therein have a frustoconical portion in which said apertures are located.

11. A space frame according to claim 2, wherein
said fastening means comprises the peripheral edge defining said aperture which edge is interrupted by a plurality of slots.

12. A space frame according to claim 2, wherein the longitudinal axis of each shaft substantially intersects the centroid of the joint to which it is fastened.

13. A space frame comprising:

a first set of beams;

a first set of joints interconnecting said first set of beams in a rigid lattice;

a second set of beams;

a second set of joints interconnecting said second set of beams in a rigid lattice; and a plurality of tubular struts interconnecting said first and second sets of joints to form a two layered rigid structure;

each of said joints comprising first and second caps receiving a plurality of beams therebetween, one of said caps having a plurality of apertures therein, each of said tubular struts having first and second shafts coupled at opposite ends and extending along the longitudinal axis of each of said tubular struts, the first shaft coupled to each strut being received in an aperture in a cap in said first set of joints, the second shaft coupled to each strut being received in an aperture in a cap in said second set of joints, each of said shafts having fastening means, coupled thereto, for maintaining the shaft in the associated aperture, each of the caps which have apertures therein comprising a generally tapering annular wall having a plurality of outwardly extending cavities formed therein, each of said cavities being defined on its sides by two generally planar, triangular opposed walls and on its top by a generally curvilinear wall and a generally planar outer wall, said generally planar outer wall having the aperture therein.

* * * * *